US008989610B2

(12) United States Patent
Asano

(10) Patent No.: US 8,989,610 B2
(45) Date of Patent: Mar. 24, 2015

(54) IMAGE FORMING APPARATUS WITH POWER FACTOR IMPROVEMENT SECTION

(71) Applicant: Canon Kabushiki Kaisha, Tokyo (JP)

(72) Inventor: Hiroki Asano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 13/671,692

(22) Filed: Nov. 8, 2012

(65) Prior Publication Data

US 2013/0121717 A1 May 16, 2013

(30) Foreign Application Priority Data

Nov. 14, 2011 (JP) ..... 2011-248778

(51) Int. Cl.
*G03G 15/00* (2006.01)
*G03G 15/20* (2006.01)

(52) U.S. Cl.
CPC ..... *G03G 15/80* (2013.01); *G03G 15/205* (2013.01)
USPC ..... 399/37; 399/88; 399/67

(58) Field of Classification Search
CPC ..... G03G 15/80; G03G 15/00; G03G 15/20
USPC ..... 399/69, 88, 37
See application file for complete search history.

(56) References Cited

U.S. PATENT DOCUMENTS 6,317,571 B1 * 11/2001 Adams ..... 399/67
2004/0005176 A1 * 1/2004 Yokozeki et al. ..... 399/328
2007/0035971 A1 * 2/2007 Yasumura
2008/0095552 A1 * 4/2008 Aiba ..... 399/90
2009/0136273 A1 * 5/2009 Kobayashi
2010/0310267 A1 * 12/2010 Shimura et al. ..... 399/69
2011/0222895 A1 * 9/2011 Higashi et al. ..... 399/88
2013/0195490 A1 * 8/2013 Iritani ..... 399/67

FOREIGN PATENT DOCUMENTS

JP 4087565 A 3/1992
JP 3466351 B2 11/2003
JP 2004077674 A * 3/2004
JP 2005168146 A * 6/2005
JP 2007101667 A 4/2007

OTHER PUBLICATIONS

Machine Translation Oishi Hiroto, Image Forming Apparatus, (JP 2004-077674) Mar. 2004.*
Machine Translation Sasaki Masato Switching Power Supply Device, (JP 2005-168146) Jun. 2005.*

* cited by examiner

*Primary Examiner* — G. M. Hyder
(74) *Attorney, Agent, or Firm* — Fitzpatrick, Cella, Harper & Scinto

(57) ABSTRACT

The image forming apparatus includes a fixing section which has a heater and heats and fixes an unfixed image, formed on a recording material, to the recording material, a power supply section which has a rectification section rectifying alternating current, a power factor improvement section receiving input of current output from the rectification section, and a DC/DC converter DC/DC converting current output from the power factor improvement section, a current detection section which detects current flowing to the heater, and a control section which controls operation of the power factor improvement section according to current detected by the current detection section.

17 Claims, 11 Drawing Sheets

IN CASE OF TURNING OFF
POWER FACTOR IMPROVEMENT SECTION

+

+

||

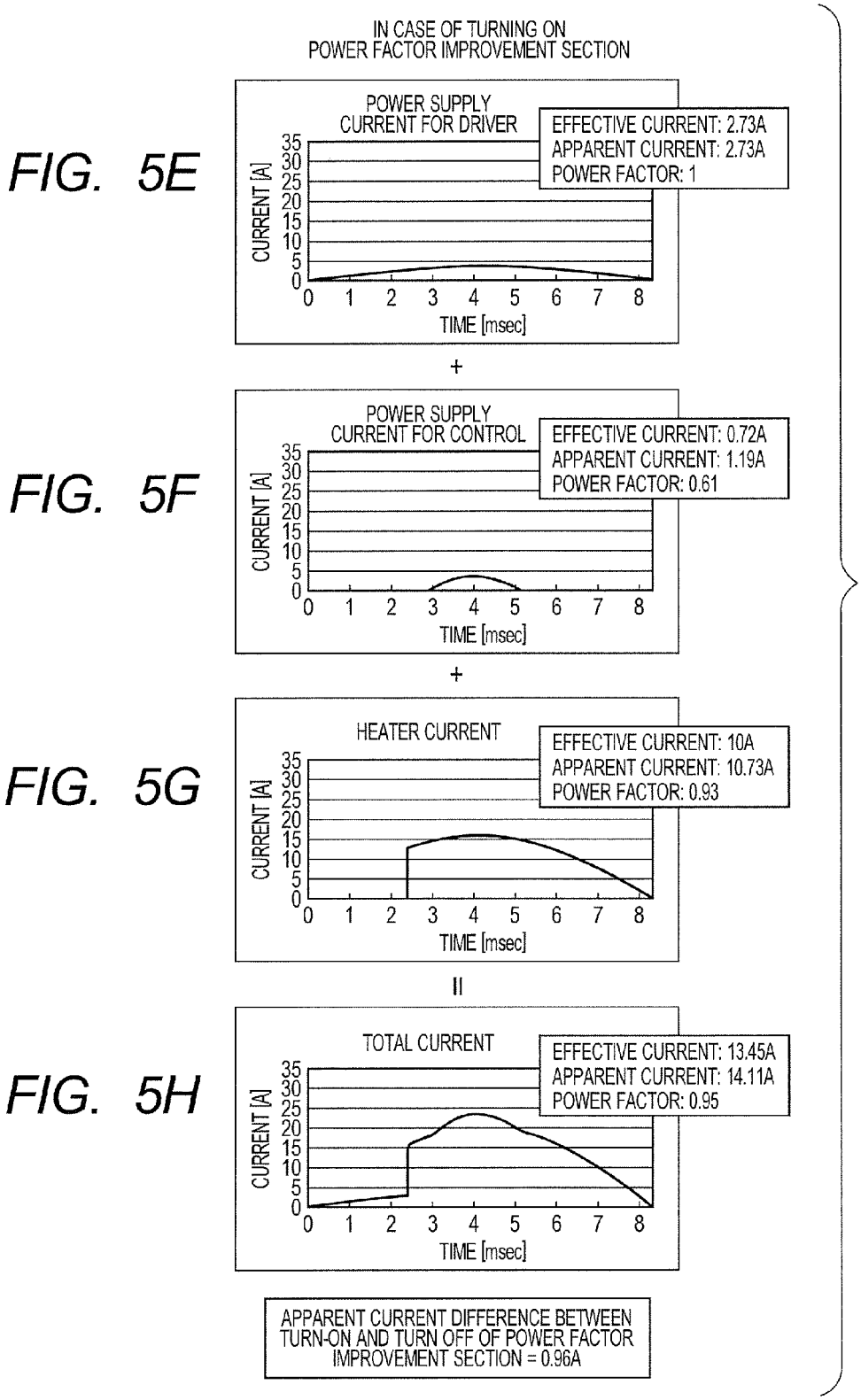
IN CASE OF TURNING ON
POWER FACTOR IMPROVEMENT SECTION
FIG. 5E
POWER SUPPLY
CURRENT FOR DRIVER
EFFECTIVE CURRENT: 2.73A
APPARENT CURRENT: 2.73A
POWER FACTOR: 1
CURRENT [A]
TIME [msec]
+
FIG. 5F
POWER SUPPLY
CURRENT FOR CONTROL
EFFECTIVE CURRENT: 0.72A
APPARENT CURRENT: 1.19A
POWER FACTOR: 0.61
CURRENT [A]
TIME [msec]
+
FIG. 5G
HEATER CURRENT
EFFECTIVE CURRENT: 10A
APPARENT CURRENT: 10.73A
POWER FACTOR: 0.93
CURRENT [A]
TIME [msec]
II
FIG. 5H
TOTAL CURRENT
EFFECTIVE CURRENT: 13.45A
APPARENT CURRENT: 14.11A
POWER FACTOR: 0.95
CURRENT [A]
TIME [msec]
APPARENT CURRENT DIFFERENCE BETWEEN
TURN-ON AND TURN OFF OF POWER FACTOR
IMPROVEMENT SECTION = 0.96A

IMAGE FORMING APPARATUS WITH POWER FACTOR IMPROVEMENT SECTION

BACKGROUND OF THE INVENTION

1. Field of the Invention

The present invention relates to an image forming apparatus provided with a power supply device having a power factor improvement section.

2. Description of the Related Art

Recently, an image forming apparatus is required to enhance the printing speed and reduce time from turning on of a commercial power supply to start of image formation, and an electric power of a heater deployed in a power supply device and a heat fixing device has been increased. In general, an input current supplied from a commercial power supply to the image forming apparatus has an upper limit of something like 15 A (ampere) in Japan, and particularly an image forming apparatus provided with a high-power power supply device and a high-power heater is required to be designed so as not to exceed this upper limit.

In order to satisfy the above requirement, there has been well known an image forming apparatus having a constitution in which electric power is effectively utilized by adding a power factor improvement section to a power supply device. Especially, the power supply device is provided with two DC/CD converters which are a DC/DC convertor supplying electric power mainly to a driving device and a DC/DC convertor supplying electric power mainly to a control device, and in many cases, the power factor improvement section is added only to the former DC/DC converter having a large supply power. As such a power factor improvement section used in a high-power power supply device, the pressure-rising type is often generally used.

However, the power factor improvement section has problems such as heat generation and reduction in efficiency due to switching loss and generation of noise, and it is preferable to operate while stopping switching of the power factor improvement section as much as possible. In order to address those problems, in Japanese Patent No. 3466351, for example, there is disclosed a constitution in which the switching of the power factor improvement section is stopped when an image forming apparatus is in a standby state. Further, in Japanese Patent Application Laid-Open No. 2007-101667, there is disclosed a constitution in which when a value of current flowing to a DC/DC converter which supplies electric power to a driving device and a control device is not more than a predetermined value, the switching of the power factor improvement section is stopped. Furthermore, in Japanese Patent Application Laid-Open No. H04-087565, there is disclosed a constitution in which the power factor improvement section is bypassed by a short circuit.

However, the above patent documents have the following problems. For example, the power factor improvement section disclosed in the Japanese Patent No. 3466351 always performs switching during a printing operation of the image forming apparatus, and there are effects of reduction of heat generation and improvement of the efficiency only when the image forming apparatus is in the standby state. In the first place, in consideration of variation in a commercial power supply voltage and a heater resistance, in order to suppress a value of current supplied from a commercial power supply to not more than a standard of current of 15 A under a condition in which the current value of the image forming apparatus is maximum, the power factor improvement section is provided in the image forming apparatus. Thus, the power factor improvement section is rarely required, and the power factor improvement section is required only during warm up at the time of turning on of the power supply of the image forming apparatus and during a period of time from several seconds to several ten seconds from start of printing at most, and the power factor improvement section may not be required according to the voltage value of the commercial power supply and the heater resistance of a fixing device.

In the constitutions disclosed in the Japanese Patent Application Laid-Opens Nos. 2007-101667 and H04-087565, although the load of the DC/DC converter is significantly different between the printing state and the standby state, a variation in the load of the DC/DC converter is small in the same operating state. Thus, in the printing state in which the load undergoes a transition while remaining large, the switching of the power factor improvement section can be hardly stopped. Accordingly, it is considered that it is less suitable to use the value of the current flowing to the DC/DC converter as a threshold value when whether or not the switching of the power factor improvement section is stopped is judged.

SUMMARY OF THE INVENTION

The present invention has been made in view of the above problems, and provides an image forming apparatus in which an operation period of a power factor improvement section is made appropriate.

Another object of the present invention is to provide an image forming apparatus having a fixing section which heats and fixes an unfixed image, formed on a recording material, to a recording material, a power supply section which has a rectification section rectifying alternating current, a power factor improvement section receiving current output from the rectification section, and a DC/DC converter DC/DC converting current output from the power factor improvement section, a current detection section which detects current flowing to the heater, and a control section which controls operation of the power factor improvement section according to current detected by the current detection section.

Still another object of the present invention is to provide an image forming apparatus having a fixing section which has a heater and heats and fixes an unfixed image, formed on a recording material, to the recording material, a power supply section which has a rectification section rectifying alternating current, a power factor improvement section receiving current output from the rectification section, a DC/DC converter DC/DC converting current output from the power factor improvement section, and a bypassing switch connected in parallel to the power factor improvement section, a current detection section which detects current flowing to the heater, and a control section which controls the bypassing switch according to current detected by the current detection section.

Further features of the present invention will become apparent from the following description of exemplary embodiments with reference to the attached drawings.

BRIEF DESCRIPTION OF THE DRAWINGS

FIGS. 5A, 5B, 5C, 5D, 5E, 5F, 5G and 5H are views for explaining a difference in apparent current according to presence of a power factor improvement section in the examples 1 and 2.

DESCRIPTION OF THE EMBODIMENTS

Hereinafter, embodiments of the present invention will be described in detail with reference to the drawings.

Embodiment 1

(1) Image Forming Apparatus

Figure 1:
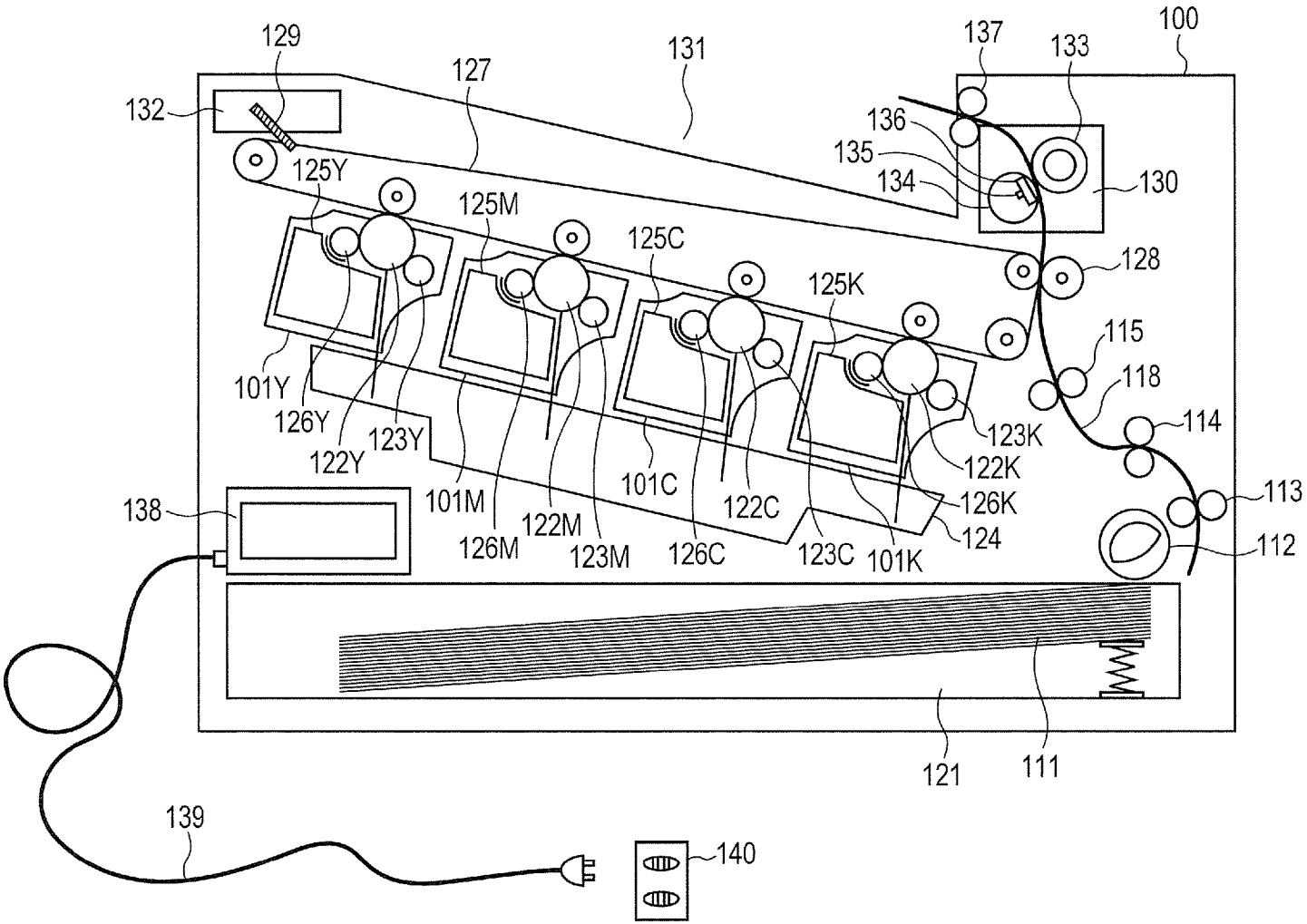
FIG. 1 is a schematic configuration diagram of an image forming apparatus in examples 1 and 2.

FIG. 1 shows a schematic configuration diagram of a color image forming apparatus of this example. In the color image forming apparatus of this example, an electrophotographic system is used, and toner images with four colors of yellow (Y), magenta (M), cyan (C), and black (K) are superimposed, whereby a full-color image is formed. An image forming apparatus 100 is constituted of a sheet feeding section 121, photosensitive drums 122 (Y, M, C, and K and hereinafter the description thereof is omitted), a charge sleeve 123, a toner container 125, a developing sleeve 126, an intermediate transfer belt 127, a transfer roller 128, and a heat fixing device 130. The photosensitive drum 122, the charge sleeve 123, the toner container 125, and the developing sleeve 126 are collected in one container for each color of Y, M, C and K as an all-in-one cartridge 101.

In the all-in-one cartridge 101 of each color, a light beam is irradiated onto the photosensitive drum 122, charged by the charge sleeve 123, from a scanner section 124 based on an exposure time converted by an image processing section (not shown), and an electrostatic latent image is formed on the photosensitive drum 122. The developing sleeve 126 develops the electrostatic latent image with toner from the toner container 125 to form a monochrome toner image on the photosensitive drum 122, and, thus, to superimpose four color toner images on the intermediate transfer belt 127, whereby a multicolor toner image is formed.

A recording sheet 111 is fed from the sheet feeding section 121 by a feed roller 112 and conveyed along a conveying path 118 while being held by conveying rollers 113, 114, and 115. Then, the recording sheet 111 is sandwiched between the intermediate transfer belt 127 formed with the multicolor toner image and the transfer roller 128 and pressurized, so that the multicolor toner image on the intermediate transfer belt 127 is transferred to the recording sheet 111. Toner remaining on the intermediate transfer belt 127 without being transferred to the recording sheet 111 is cleaned by the cleaner 129, and cleaned waste toner is accumulated in a cleaner container 132.

The recording sheet 111 transferred with the toner image is further conveyed along the conveying path 118, and the toner image is fixed onto the recording sheet 111 by a heat fixing device 130. The heat fixing device 130 of this example uses a film heat method and is constituted of a heater 136, a fixing film (endless belt) 134, a pressure roller 133, a thermistor 135, and so on. The pressure roller 133 is rotated and driven at a predetermined peripheral velocity by a fixing drive motor (not shown). By the rotational driving of the pressure roller 133, the rotational force is directly applied to the fixing film 134 by a frictional force between the pressure roller 133 and an outer surface of the fixing film 134, the fixing film 134 is rotated and driven while being in press contact and sliding with the heater 136. The thermistor 135 is pressed against a rear surface of the heater 136 by a predetermined pressure and detects the temperature of the rear surface of the heater 136.

The rotation of the fixing film 134 according to the rotation of the pressure roller 133 is stabilized, and when the heater 136 is in such a state that the temperature is increased to a predetermined temperature, the recording sheet 111 transferred with a toner image is conveyed to a nip portion formed by the fixing film 134 and the pressure roller 133. The conveyed recording sheet 111 is conveyed while being pressurized in the nip portion, whereby the heat of the heater 136 is applied to the recording sheet 111 through the fixing film 134, and the toner image is heat-fixed to the recording sheet 111. After that the recording sheet 111 to which the toner image is heat-fixed passes through a discharge roller 137 and is discharged onto a discharge tray 131.

Electric power required for executing the above-described image forming process is supplied to each section of the image forming apparatus 100 by a power supply device 138 receiving a supply of electric power from a commercial power supply 140 through an AC cable 139. The details of the power supply device 138 will be described later.

(2) Power Supply Control to Heater

Figure 2:
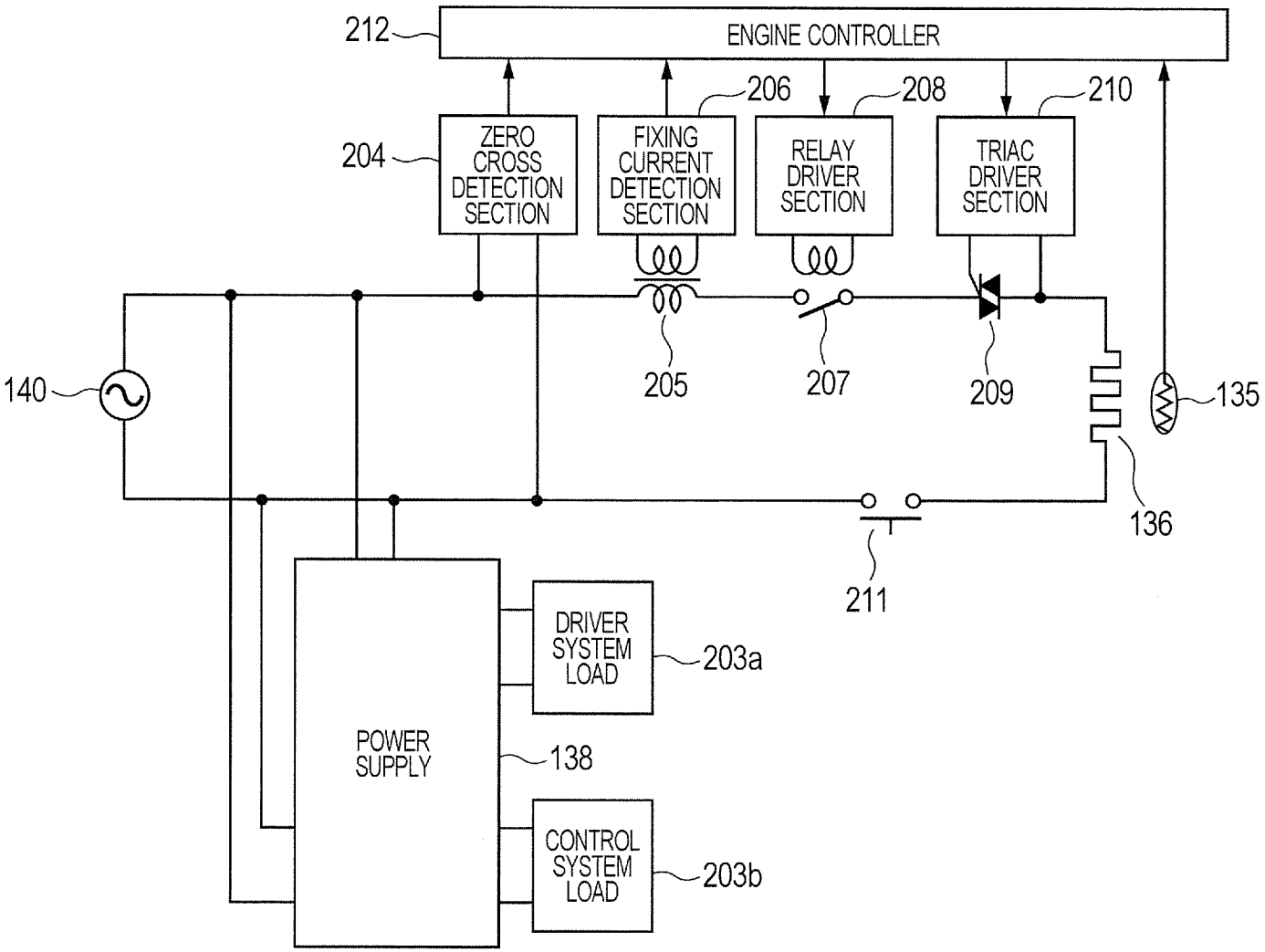
FIG. 2 is a schematic diagram showing a power supply device and a heater control section in the examples 1 and 2.

The power supply control the heater 136 in the heat fixing device 130 will be described using FIG. 2. FIG. 2 is a schematic diagram showing the power supply device 138 receiving the supply of electric power from the commercial power supply 140 in the image forming apparatus 100 and a heater control section of the heat fixing device 130. A power supply line from the commercial power supply 140 is separated into two power supply lines, one to the heater 136 and the other to each load of other than the heater 136 (a driver system load 203*a* and a control system load 203*b*) through the power supply device 138.

The heater 136 receives a supply of electric power from the commercial power supply 140 through a current transformer 205, a relay 207, a bidirectional three-terminal thyristor (hereinafter referred to as a triac) 209. A thermoswitch 211 is disposed so as to be in contact with or adjacent to the heater 136 and used as a protection element which cuts off the power supply line from the commercial power supply 140 when the temperature of the heater 136 is abnormally high. A temperature fuse may be used as a protective element instead of the thermoswitch 211. The triac 209 is an element for controlling a power supply/cutting off of the power supply to the heater 136, and on/off control of the triac 209 is performed by phase control to be described later through a triac driver section 210.

A zero-cross detection section 204 monitors a voltage of the commercial power supply 140 to detect a timing when the voltage passes through 0 V (zero-cross point), and, thus, to output a zero-cross signal to an engine controller 212. A fixing current detection section 206 detects a value of current supplied to the heater 136 through the current transformer 205 and outputs a detection signal to the engine controller 212. The thermistor 135 detects the temperature of the heater 136. The engine controller 212 performs drive control of the relay 207 through a relay driver section 208 based on detection signals from the zero-cross detection section 204 and the fixing current detection section 206, the temperature detected by the thermistor 135, and so on. Further, the engine controller 212 performs control of the image forming operation of the image forming apparatus 100, such as the on/off control of the triac 209, through the triac driver section 210. The engine controller 212 has ROM and RAM (not shown). The ROM holds a control program and data executed by the engine controller 212, and the RAM is used for the control program executed by the engine controller 212 to temporally hold information.

Figure 3A:
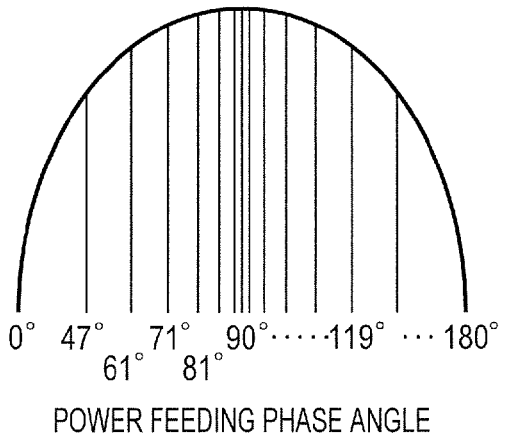
FIGS. 3A, 3B and 3C are views for explaining phase control in the examples 1 and 2.

In this example, the electric power is supplied to the heater 136 by the phase control. The phase control is a method of decomposing one half wave of the commercial power supply 140 into a plurality of waves as shown in FIG. 3A to turn on the triac 209 at a predetermined phase angle (hereinafter referred to as a "power feeding phase angle"), and, thus, to control the power supply to the heater 136. A method of synchronizing with a voltage phase of the commercial power supply 140 is performed using the zero-cross signal output when the voltage of 0 V is detected by the zero-cross detection section 204.

Figure 3B:
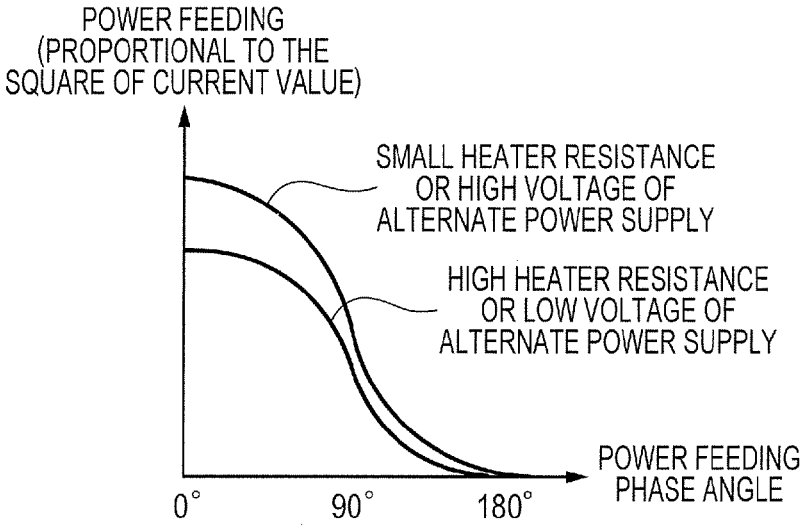

FIG. 3B is a graph showing a relationship between the electric power supplied to the 136 and the power feeding phase angle. In FIG. 3B, the vertical axis shows the electric power supplied to the heater 136 that is proportional to the square of the current value, and the horizontal axis shows the power feeding phase angle. From the waveform of FIG. 3B, it can be shown that as the power feeding phase angle approaches nearer 0°, the electric power supplied to the heater 136 becomes large, and whereas, as the power feeding phase angle approaches nearer 180°, the electric power supplied to the heater 136 becomes small. Particularly, when the power feeding phase angle is 0°, the maximum electric power is supplied to the heater 136, and when the power feeding phase angle is 180°, the electric power supplied to the heater 136 is zero. In FIG. 3B, the upper waveform chart shows a relationship between the supplied electric power and the power feeding phase angle when the resistance value of the heater 136 is small or when the voltage of the commercial power supply 140 is large, and the lower waveform chart shows the relationship between the supplied electric power and the power feeding phase angle when the resistance value of the heater is large or when the voltage of the commercial power supply is small. From the two waveform charts, it can be shown that the larger the heater resistance, or the smaller the commercial power supply voltage, the smaller the electric power injected into the heater 136, and whereas, the smaller the heater resistance, or the larger the commercial power supply voltage, the larger the electric power injected into the heater 136.

Figure 3C:
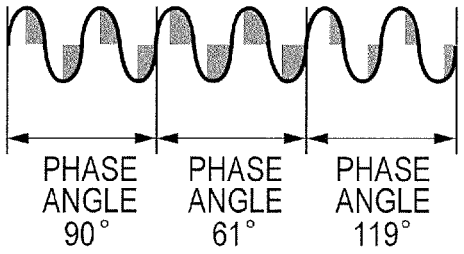

FIG. 3C shows an example of a power supply pattern during the phase control, and the power supply patterns in the cases where the power feeding phase angle is 90 degrees, 61 degrees, and 119 degrees are shown from the left side. In FIG. 3C, a hatched portion shows that the electric power is injected, and a non-hatched portion shows that the electric power is not injected.

(3) Power Supply Device

Figure 4:
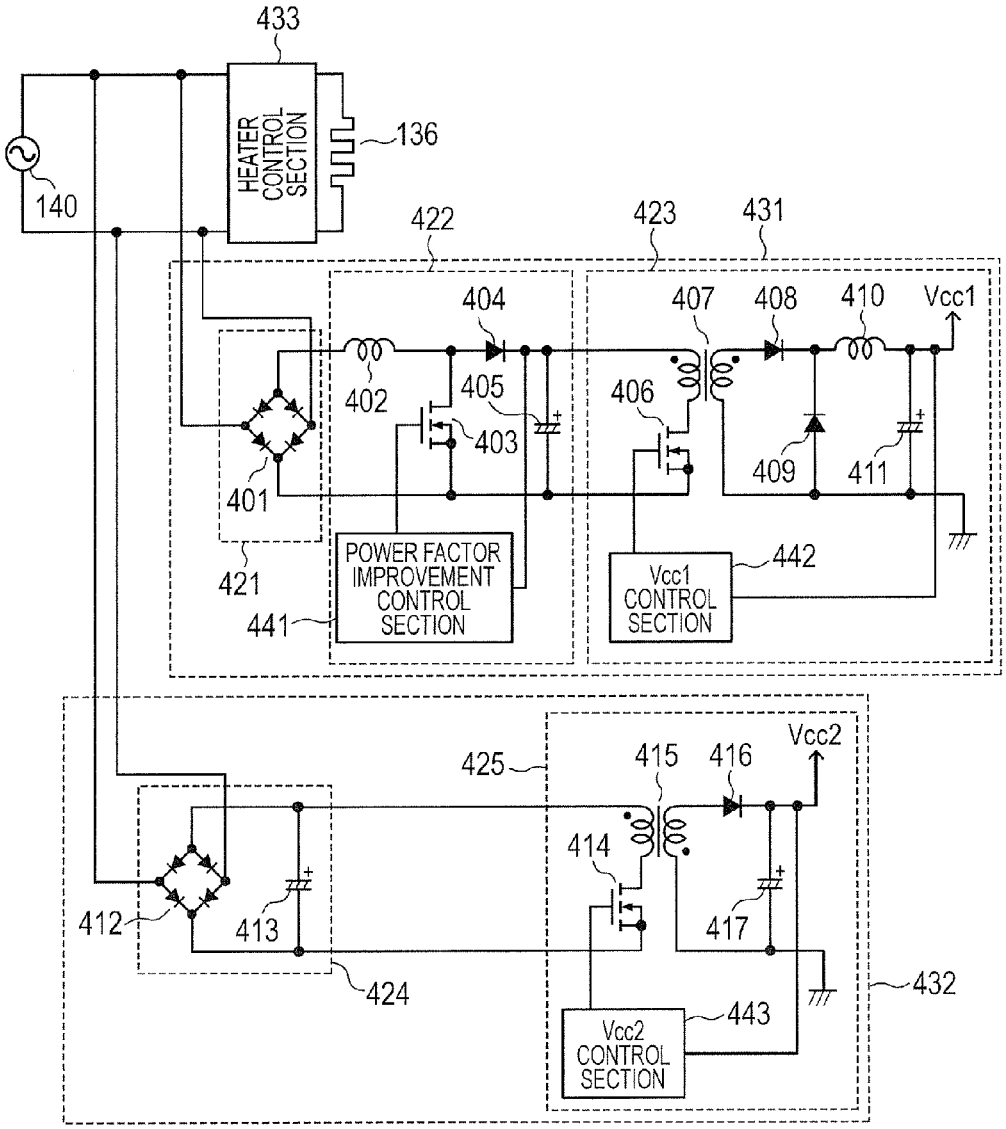
FIG. 4 is a circuit diagram of the power supply device in the embodiment 1.

The power supply device 138 which supplies the electric power to each section of the image forming apparatus 100 will be described using FIG. 4. FIG. 4 is a schematic circuit diagram of the power supply device 138. As shown in FIG. 4, the power supply device 138 shown in FIG. 2 is constituted of a driving power supply device 431 supplying the electric power to the driver system load 203*a* and a controlling power supply device 432 supplying the electric power to the control system load 203*b*. The driving power supply device 431 is constituted of a rectification section 421, a power factor improvement section 422, and a forward system DC/DC converter (direct current to direct current converter) 423 and outputs a direct voltage Vcc1. Meanwhile, the controlling power supply device 432 is constituted of a rectification smoothing section 424 and a DC/DC converter 425 and outputs a direct voltage Vcc2. A heater control section 433 of FIG. 4 is constituted of the engine controller 212, the zero-cross detection section 204, the fixing current detection section 206, the relay driver section 208, the triac driver section 210, the current transformer 205, and the thermoswitch 211 shown in FIG. 2, and so on.

In the driving power supply device 431, alternating current supplied from the commercial power supply 140 is first rectified by a rectifying diode 401 in the rectification section 421, and a rectified direct current is input to the power factor improvement section 422. The power factor improvement section 422 is constituted of a choke coil 402, an FET (field-effect transistor) 403, a diode 404, a smoothing capacitor 405, and a power factor improvement control section 441. The power factor improvement control section 441 inputs a pulse signal (PWM signal) that controls turning on/off of the FET 403 to a gate terminal of the FET 403 based on the output of the diode 404 so that an input current waveform is close to a sine wave and duty-controls the FET 403. Hereinafter, a state in which the power factor improvement control section 441 of the power factor improvement section 422 duty-controls the FET 403 by the on instruction of power factor control from the engine controller 212 is expressed as "a state in which the power factor improvement section 422 is turned on". Meanwhile, a control state in which the power factor improvement control section 441 of the power factor improvement section 422 places the FET 403 in the turned-off state by the off instruction of the power factor control from the engine controller 212 is expressed as "a state in which the power factor improvement section 422 is turned off". The DC/DC converter 423 is constituted of an FET 406, a trans 407, a rectifying diode 408, a free-wheel diode 409, a choke coil 410, a capacitor 411, and a Vcc1 control section 442. A primary winding wire and a secondary winding wire are wound around the trans 407, and one terminal of the primary winding wire is connected to the power factor improvement section 422, and the other terminal is connected to a drain terminal of the FET 406. The secondary winding wire side of the trans 407 is constituted of the rectifying diode 408, the free-wheel diode 409, the choke coil 410, the capacitor 411, and so on and outputs the voltage Vcc1. The FET 406 is turned on/off by applying a pulse signal from the Vcc1 control section 442 to a gate terminal. The Vcc1 control section 442 controls the duty ratio of the pulse signal, whereby the DC/DC converter 423 outputs the stable voltage Vcc1.

Meanwhile, in the controlling power supply device 432, the alternating current supplied from the commercial power supply 140 is rectified and smoothed by the rectification smoothing section 424 constituted of a rectifying diode 412 and a capacitor 413 and input to the DC/DC converter 425. The DC/DC converter 425 is constituted of an FET 414, a trans 415, a rectifying diode 416, a capacitor 417, and a Vcc2 control section 443. One terminal of a primary winding wire of the trans 415 is directly connected to the output side of the rectifying diode 412 of the rectification smoothing section 424, and the other terminal is connected to a drain terminal of the FET 414. The secondary winding wire side of the trans 415 is constituted of the rectifying diode 416, the capacitor 417, and so on and outputs the voltage Vcc2. The Vcc2 control section 443 duty-controls a pulse signal, which is input to a gate terminal of the FET 414 and controls the turning on/off of the FET 414, in order to output the stable voltage Vcc2.

When the FET 406 of the DC/DC converter 423 is duty-controlled by the Vcc1 control section 442 in such a state that the power factor improvement section 422 is turned on, the voltage Vcc1 is output in such a state that the power factor of the current input to the rectification section 421 is approximately 1. Meanwhile, even though the FET 406 of the DC/DC converter 423 is duty-controlled by the Vcc1 control section 442 in such a state that the power factor improvement section 422 is turned off, although the voltage Vcc1 is output, the power factor of the current input to the rectification section 421 is not enhanced.

Figure 5A:
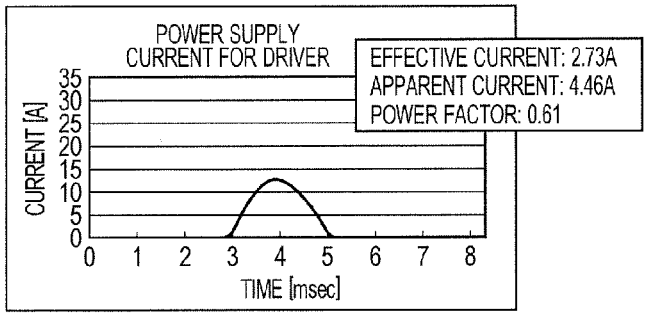
Figure 5B:
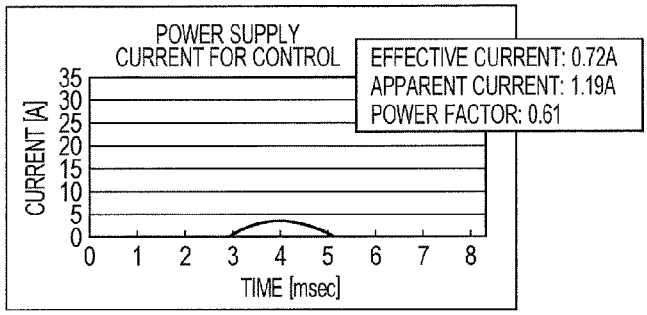
Figure 5C:
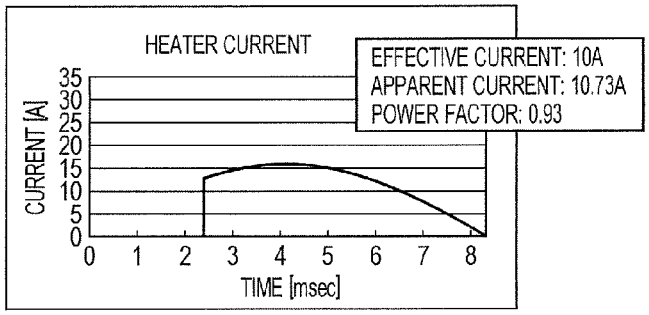
Figure 5D:
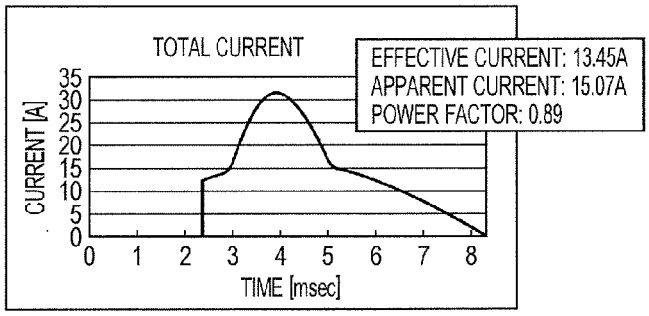

Next, the effect of adding the power factor improvement section 422 between the rectification section 421 and the DC/DC converter 423 will be described using a specific example shown in FIGS. 5A to 5H. Regarding the load (electric power) during printing in the image forming apparatus 100 of this example, the load of the driving power supply device 431 is 300 W, the load of the controlling power supply device 432 is 80 W, and the load of the heater 136 is 1100 W. Further, the voltage of the commercial power supply 140 is set to 110 V. In the above conditions, the waveforms of the current flowing to each load when the image forming apparatus 100 performs the printing operation in such a state that the power factor improvement section 422 is turned off are shown in FIGS. 5A, 5B, and 5C. FIG. 5A shows the waveform of the current flowing to the driving power supply device 431, FIG. 5B shows the waveform of the current flowing to the controlling power supply device 432, and FIG. 5C shows the waveform of the current flowing to the heater 136. In FIGS. 5A to 5H, the vertical axis shows a current value (unit: A), and the horizontal axis shows time (unit: msec). FIG. 5D shows the waveform of a total current obtained by adding the currents shown in FIGS. 5A to 5C, that is, the total current flowing to the image forming apparatus 100.

In FIGS. 5A to 5C, an effective current value is calculated by dividing each load (electric power) of the driving power supply device 431, the controlling power supply device 432, and the heater 136 by a voltage of 110 V of the commercial power supply 140, and an apparent current value is calculated based on each waveform charts. In FIGS. 5A to 5C, the power factor is calculated by dividing the effective current value by the apparent current value. The effective current value of FIG. 5D is a total of the effective current values of FIGS. 5A to 5C, the apparent current value is calculated based on the waveform chart, and the power factor is calculated by diving the effective current value by the apparent current value. As shown in FIGS. 5A and 5B, the power factors of the driving power supply device 431 and the controlling power supply device 432 are low, such as approximately 0.61, and about 2 A is a reactive current in total. Although the heater 136 is a resistance load, since the engine controller 212 phase controls the power supply from the commercial power supply 140 to the heater 136, the power factor is slightly reduced, such as not 1 but 0.93 as shown in FIG. 5C. As shown in FIG. 5D, when the currents flowing to all the loads are summed, the power factor is 0.89, and it can be shown that about 1.6 A (=15.07 A−13.45 A) that is a difference obtained by subtracting the effective current value from the apparent current value is a reactive current.

Meanwhile, FIGS. 5E, 5F, 5G, and 5H are views showing a current waveform flowing to each load when the printing operation is performed in such a state that the power factor improvement section 422 added to the driving power supply device 431 is turned on and a waveform of a total current flowing to the image forming apparatus 100. FIG. 5E is a view showing the waveform of current flowing to the driving power supply device 431, FIG. 5F is a view showing the waveform of current flowing to the controlling power supply device 432, and FIG. 5G is a view showing the waveform of current flowing to the heater 136. In FIGS. 5A to 5H, the vertical axis shows the current value (unit: A), and the horizontal axis shows time (unit: msec). FIG. 5H shows the waveform of the total current obtained by adding the currents shown in FIGS. 5E to 5G, that is, the total current flowing to the image forming apparatus 100. FIGS. 5E, 5F, 5G, and 5H correspond to FIGS. 5A, 5B, 5C, and 5D, respectively, and since FIGS. 5F and 5B and FIGS. 5G and 5C are the currents flowing to a circuit without the power factor improvement section 422, the same waveform is shown. Since the methods of calculating the effective current value, the apparent current value, and the power factor in FIGS. 5E, 5F, 5G, and 5H are similar to those in the FIGS. 5A, 5B, 5C, and 5D, description thereof will be omitted.

FIG. 5E is a waveform chart showing the state in which the power factor improvement section 422 is turned on, and the power factor of the driving power supply device 431 is improved to 1 from 0.61 in FIG. 5D showing the state in which the power factor improvement section 422 is turned off. From FIG. 5H, it can be shown that when all loads are summed, the power factor is enhanced to be 0.95, the reactive current value is 0.66 A (=14.11 A−13.45 A) and is reduced by about 1 A in comparison with FIG. 5D showing the state in which the power factor improvement section 422 is turned off. From this fact, it can be shown that in order to satisfy the standard of current of 15 A, provision of the power factor improvement section 422 is considerably effective. The reason that the power factor improvement section 422 is added to the driving power supply device 431 is that the load of the driving power supply device 431 is larger than the load of the controlling power supply device 432, and a larger power factor improvement effect is obtained.

Figure 6:
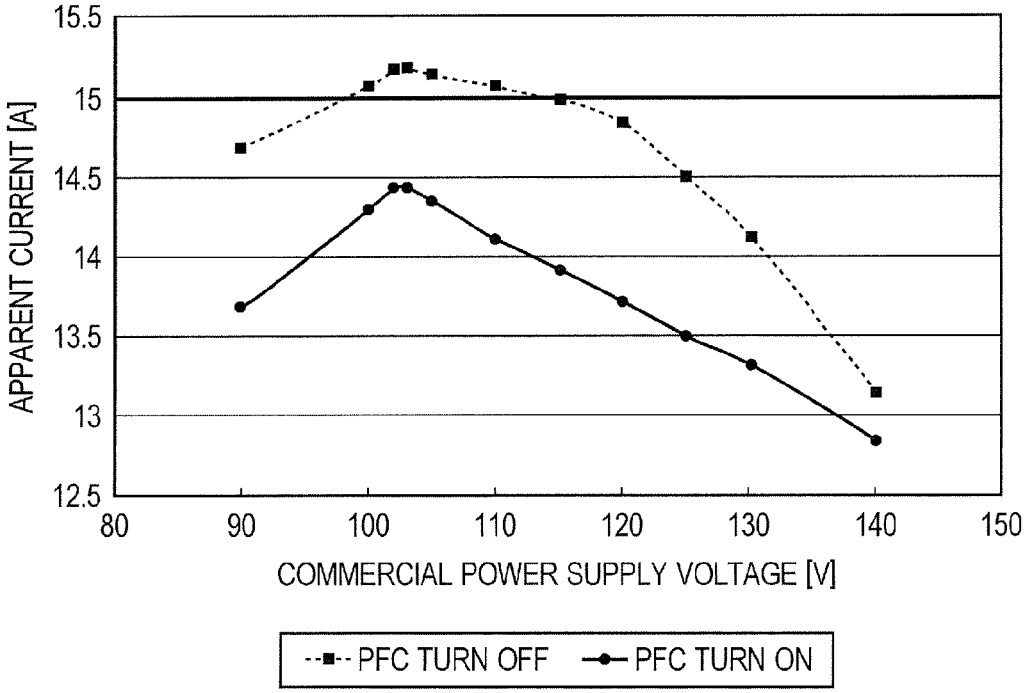
FIG. 6 is a view for explaining a relationship between the apparent current and a commercial power supply voltage in the examples 1 and 2.

Next, the condition that the current flowing to the image forming apparatus 100 is maximum will be described using FIG. 6. FIG. 6 is a view showing a relationship between the voltage of the commercial power supply 140 and the value of the apparent current flowing to the image forming apparatus 100. In FIG. 6, the vertical axis shows a value of the apparent current (unit: A), and the horizontal axis shows the commercial power supply voltage (unit: V). In FIG. 6, the solid waveform shows the state in which the power factor improvement (PFC: Power Factor Correction) section 422 is turned on, and the dashed waveform shows the relationship between the commercial power supply voltage and the apparent current in the state in which the power factor improvement section 422 is turned off. As described above, regarding the load of the image forming apparatus 100 during printing, the load of the driving power supply device 431 is 300 W, the load of the controlling power supply device 432 is 80 W, and the load of the heater 136 is 1100 W. The heater resistance is set to 9.56Ω.

From FIG. 6, it can be shown that there is a point at which the apparent current is maximum near the commercial power supply 140 of 100 V regardless of the turned on/off state of the power factor improvement section 422.

(4) Fixing Current Detection Section

The current supplied to the heater 136 is voltage-converted by the trans 205 shown in FIG. 2, converted into an effective value in the fixing current detection section 206, and input as an analog signal to the engine controller 212. The engine controller 212 performs the power supply control to the heater 136 based on the current value to the heater 136 converted from the input analog signal to a digital signal so that the current value does not exceed a rated current of 15 A of the commercial power supply 140.

Since the current value output in the fixing current detection section 206 is an integrated value corresponding to a half period of a power supply frequency of a square waveform, the current value depends on the frequency, and the frequency of a power supply is required to be performed at the same time. In this example, the frequency of the power supply is calculated from an interval time at the falling of a zero-cross signal pulse detected by the zero-cross detection section 204. The current detection timing is time corresponding to one period of the power supply. The fixing current detection section 206 is used as a protection circuit (not shown) which cuts off connection of the relay 207 when an abnormal current flows to the heater 136.

(5) On/Off Control of Power Factor Improvement Section

Since the power factor improvement section 422 described above has problems such as heat generation and reduction in efficiency due to the switching loss of the FET 403 and generation of noise, it is preferable to hold the power factor improvement section 422 in the turned-off state as much as possible. Thus, the engine controller 212 performs control in which the power factor improvement section 422 is turned on when the current value detected by the fixing current detection section 206 is more than a predetermined value, and the power factor improvement section 422 is turned off when the current value is less than the predetermined value. The load of the heater 136 accounts for a large percentage of all loads of the image forming apparatus 100. For example, in an image forming apparatus corresponding to A3 color with approximately 30 ppm (page per minutes), as described in "(3) Power supply device", in comparison with the fact that the load of the power supply device 138 is approximately 380 W, the load of the heater 136 is approximately 1100 W. Moreover, in comparison with the power supply device 138, the load of the heater 136 is always significantly varied. Thus, as the threshold value of the current used for judging turning on/off of the power factor improvement section 422, it is suitable to use not the current value of the current flowing to the DC/DC converter 423 but the current value of the current flowing to the heater 136.

Figure 7:
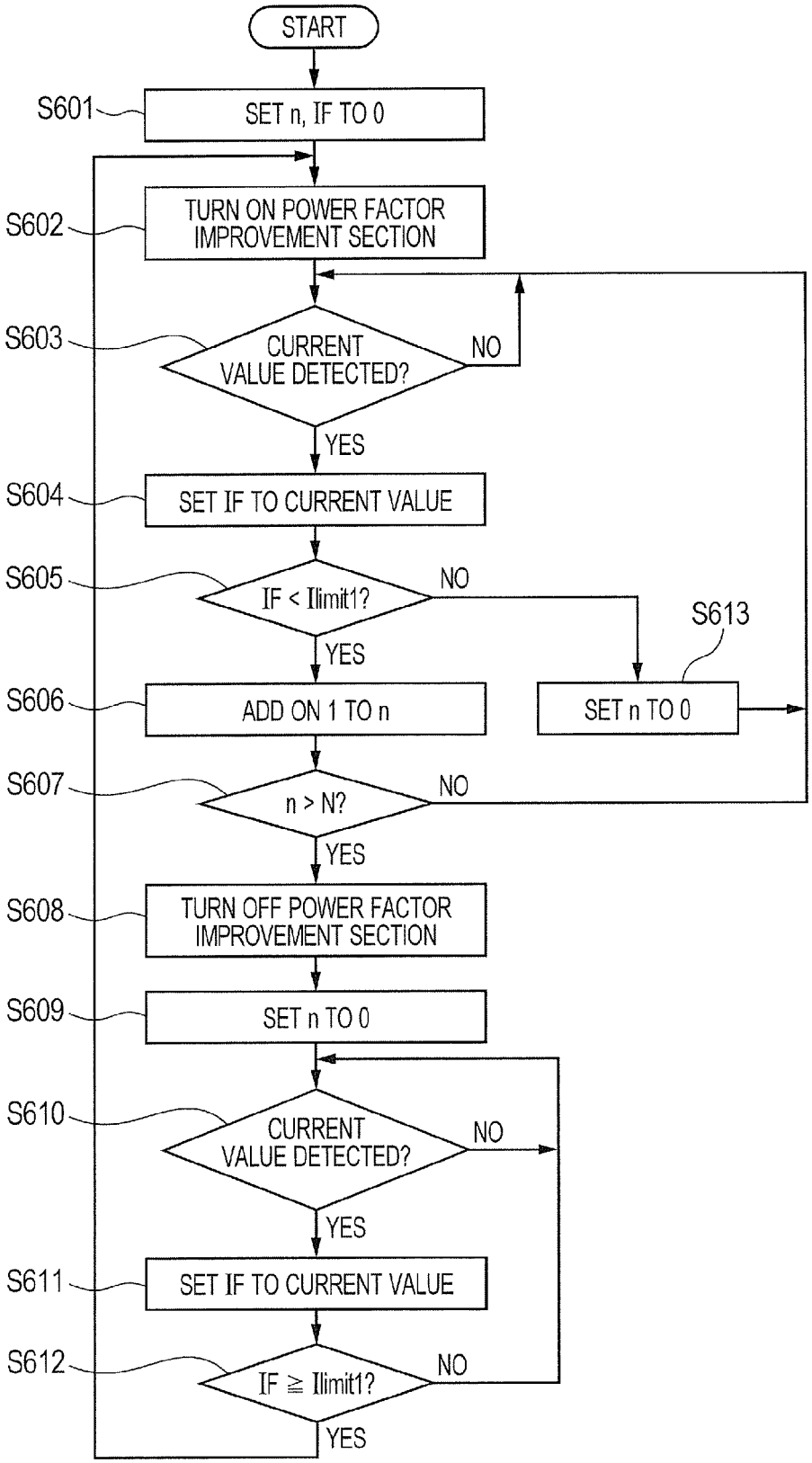
FIG. 7 is a flow chart showing a processing sequence of on/off control of the power factor improvement section in the embodiment 1.

Hereinafter, the on/off control of the power factor improvement section 422 will be described based on the current value detected by the fixing current detection section 206, using the flow chart of FIG. 7. The processing shown in FIG. 7 is executed by the engine controller 212 based on a control program stored in the ROM (not shown) of the engine controller 212. The processing of the flow chart in the subsequent example is executed by the engine controller 212 as in the processing shown in FIG. 7.

FIG. 7 is a flow chart showing a processing sequence of the on/off control of the power factor improvement section 422 activated when the power supply of the image forming apparatus is turned on. First, when the power supply of the image forming apparatus 100 is turned on, in step 601 (hereinafter referred to as S601), the engine controller 212 writes 0 in variables n and IF as memories provided in the RAM (not shown) of the engine controller 212. The variable IF is a memory which stores the latest current value detected by the fixing current detection section 206, and the current value is updated for each detection of the current value, that is, each one period of the commercial power supply 140. In the processing of S605 to be described later, the variable n is used as a memory which stores the number of times the current value detected by the fixing current detection section 206 is less than Ilimit1 being a first threshold value. In S602, in preparation for warm-up of the image forming apparatus 100, the engine controller 212 instructs the turned on state of the power factor improvement section 422 to the power factor improvement control section 441 so that the power factor improvement control section 441 performs duty control of the FET 403 based on the output of the diode 404.

In S603, the engine controller 212 judges whether the detection signal of the current value to the heater 136 detected by the fixing current detection section 206 is input. In the engine controller 212, when the detection signal is input, the operation proceeds to S604, and when detection signal is not input, the processing in S603 is repeated. As described above, the timing at which the detection signal is input from the fixing current detection section 206 to the engine controller 212 is for each one period of the power supply. In S604, the engine controller 212 writes the current value detected in S603 in the variables IF and updates the memory content of the variable IF. In S605, the engine controller 212 judges whether the current value stored in the variable IF is less than the threshold value Ilimit1, and when the current value stored in the variable IF is less than the threshold value Ilimit1, the operation proceeds to S606, or otherwise the operation proceeds to S613. The value of the threshold value Ilimit1 is set so that the value of the current supplied from the commercial power supply 140 to the image forming apparatus 100 does not exceed the standard of current of 15 A (ampere) even in such a state that the engine controller 212 places the power factor improvement section 422 in the turned off state. Namely, when the current value detected by the fixing current detection section 206 is less than the threshold value Ilimit1 (less than a first threshold value), the standard of current of 15 A of the commercial power supply can be satisfied even in the state in which the power factor improvement section 422 is turned off. In this example, the maximum current value assigned to the heater is set to 10 A so that the value of current supplied from the commercial power supply to the image forming apparatus does not exceed the maximum value of 15 A of the standard of current in such a state that the current value is the threshold value Ilimit1, that is, the operation of the power factor improvement section is stopped.

In S606, the engine controller 212 adds 1 as a stored value to the variable n and updates the value. In S607, the engine controller 212 judges whether the value of the variable n is more than a constant N. When the value of the variable n is more than the constant N, the operation proceeds to S608, and when the value of the variable n is not more than the constant N, the operation returns to S603. The constant N will be described later. In S613, the engine controller 212 writes 0 in the variable n, and the operation proceeds to S603.

In S608, the engine controller 212 places the power factor improvement section 422 in the turned off state and instructs the power factor improvement control section 441 to prevent the power factor improvement control section 441 from duty-controlling the FET 403. In S609, the engine controller 212 writes 0 in the variable n and resets the value. In S610, the engine controller 212 judges whether the detection signal of the current value to the heater 136 detected by the fixing current detection section 206 is input. In the engine controller 212, when the detection signal is input, the operation proceeds to S611, and when the detection signal is not input, the processing of S610 is repeated. In S611, the engine controller 212 writes the current value detected in S610 in the variable IF and updates the memory contents of the variable IF. In S612, the engine controller 212 judges whether the current value stored in the variable IF is not less than the threshold value Ilimit1. When the current value stored in the variable IF is not less than the threshold value Ilimit1 (not less than a first threshold value), the operation proceeds to S602, and otherwise the operation returns to S610.

In the flow chart of FIG. 7, the variable n and the constant N are provided in order to prevent malfunctions of a circuit of the fixing current detection section 206. Due to the malfunctions of the fixing current detection section 206, the current value less than the threshold value is detected, and when the engine controller 212 immediately turns off the power factor improvement section 422, the current flowing to the image forming apparatus 100 may exceed the standard of current value of 15 A. Thus, when the engine controller 212 instructs the power factor improvement control section 441 to place the power factor improvement section 422 in the turned off state, the instruction is delayed by the update time of the fixed current value IF. Namely, when the current values detected by the fixing current detection section 206 are less than the threshold value Ilimit1 N times in a row, the power factor improvement section 422 is placed in the turned off state, and therefore, in order to prevent the malfunctions, a guard time corresponding to time obtained by multiplying one period of the commercial power supply 140 by the constant N is provided.

Figure 8:
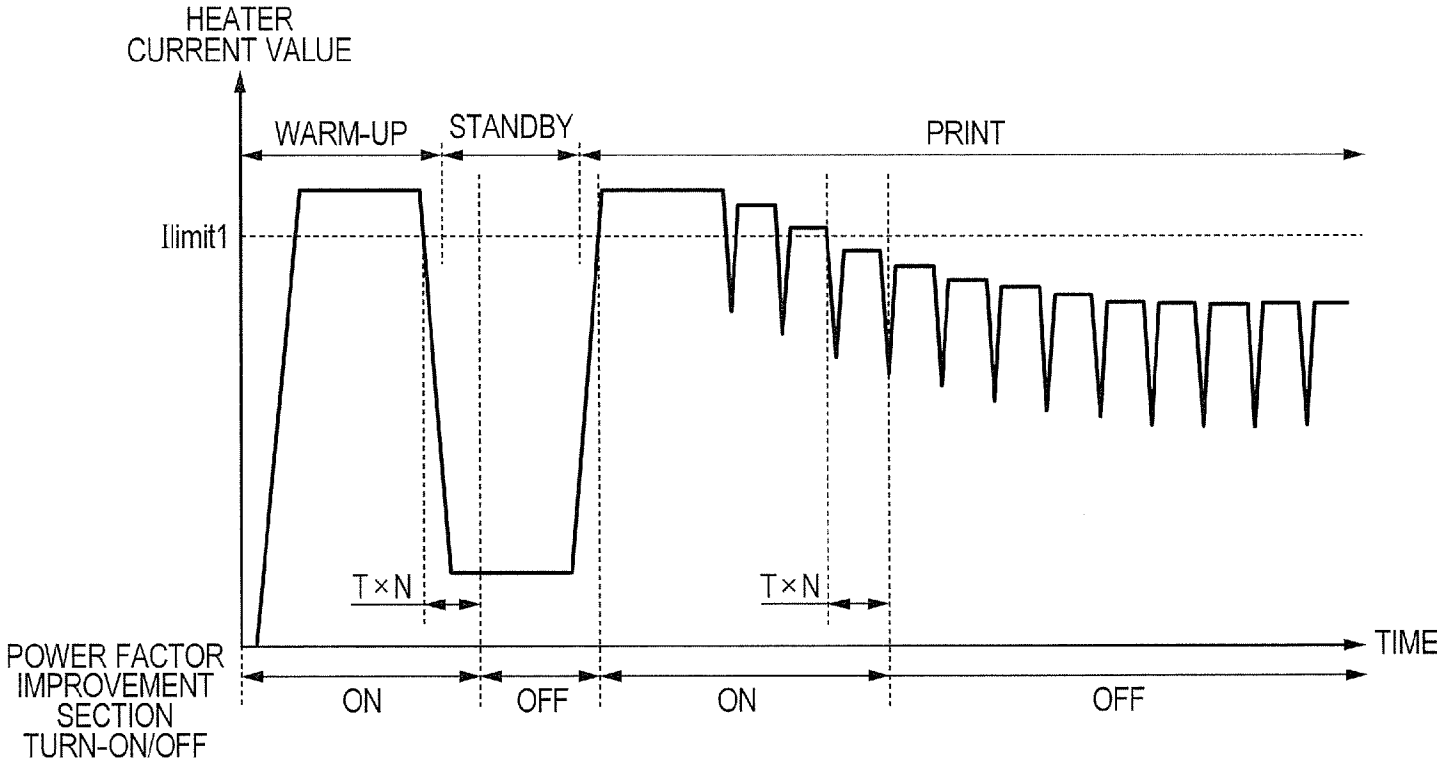
FIG. 8 is a view showing a change of heater current of the image forming apparatus in the examples 1 and 2.

In accordance with the above-mentioned control flow of FIG. 7, a state in which the turned on/off state of the power factor improvement section 422 changes with the passage of the time when the power supply of the image forming apparatus 100 is actually turned on to perform the printing operation is shown in FIG. 8. In FIG. 8, the horizontal axis shows time, and the vertical axis shows the current value (the value of current flowing to the heater 136) detected by the fixing current detection section 206. First, when the power supply of the image forming apparatus 100 is turned on, the warm-up operation of the image forming apparatus 100 is started to rapidly increase the heater temperature, and therefore, a large current more than the threshold value Ilimit1 flows to the heater 136. While the current more than the threshold value Ilimit1 flows to the heater 136, the engine controller 212 holds the power factor improvement section 422 in the turned on state. When the warm-up operation of the image forming apparatus 100 is terminated, the image forming apparatus 100 enters into the standby state. The current supplied from the commercial power supply 140 to the heater 136 is significantly reduced, and the current value is less than the threshold value Ilimit1; therefore, the engine controller 212 places the power factor improvement section 422 in the turned off state. At this time, due to the reason as above, when the value of current supplied to the heater 136 is less than the threshold value Ilimit1, the engine controller 212 does not immediately place the power factor improvement section 422 in the turned off state but places the power factor improvement section 422 in the turned off state after a lapse of T×N time as a predetermined time. T represents the time of one period of the commercial power supply 140, and N represents the constant described in FIG. 7.

Subsequently, when the image forming apparatus 100 receives a printing operation signal to start printing in the image forming apparatus 100, the value of the current supplied to the heater 136 exceeds the threshold value Ilimit1 again, and the engine controller 212 places the power factor improvement section 422 in the turned on state. At this time, when the value of the current supplied to the heater 136 is more than the threshold value Ilimit1, the engine controller 212 immediately places the power factor improvement section 422 in the turned on state. When the printing operation is continued, heat is gradually accumulated in the heat fixing device 130, and the electric power supplied to the heater 136 is reduced. Consequently, the electric power supplied to the heater 136 is reduced, and when the value of the current supplied to the heater 136 detected for each one period of the commercial power supply 140 is less than the threshold value Ilimit1 N times in a row, the engine controller 212 places the power factor improvement section 422 in the turned off state.

As described above, according to this example, the switching loss of the power factor improvement section can be suppressed. Especially, in this example, even during the image forming operation, the operation of the power factor improvement section is stopped in many times, whereby the switching loss of the power factor improvement section can be minimized while satisfying the standard of current of 15 A of the commercial power supply.

Embodiment 2

In the embodiment 1, the turning on/off of the power factor improvement section is controlled based on the value of current flowing to the heater, whereby the switching loss in the power factor improvement section can be suppressed. In the embodiment 2, a bypassing switch connected in parallel to the power factor improvement section is provided, whereby loss in the elements constituting the power factor improvement section is improved. Since the image forming apparatus, the control of the electric power supply to the heater, and the constitution of the fixing current detection section 206 in this example are the same as those in the embodiment 1, the descriptions thereof are omitted, and portions different from the embodiment 1 will be described hereinafter.

(1) Power Supply

Figure 9:
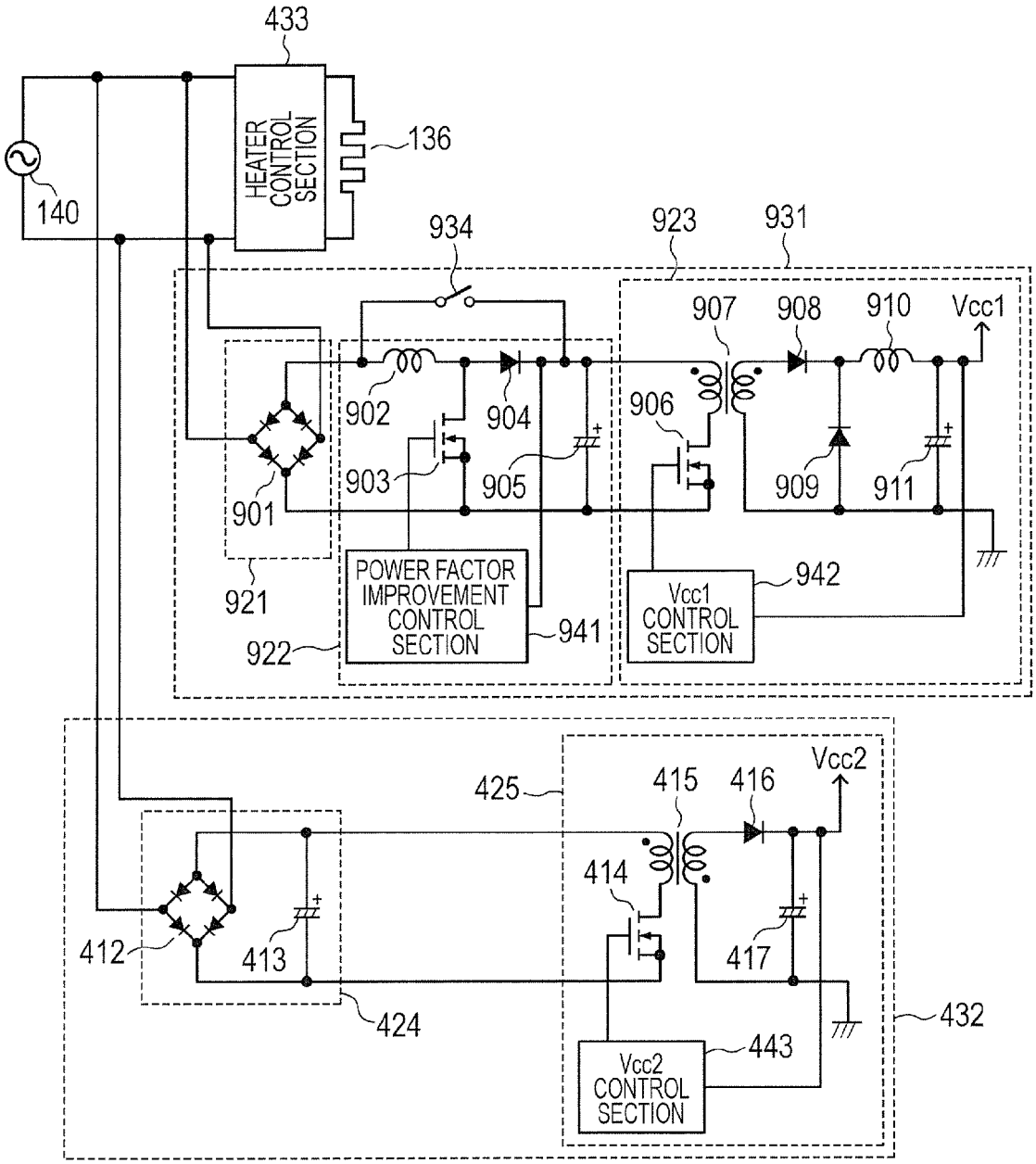
FIG. 9 is a circuit diagram of the power supply device in the embodiment 2.

FIG. 9 is a view showing a power supply device 138 of an image forming apparatus 100 of this example. In comparison with FIG. 4 of the embodiment 1, the circuit configuration of FIG. 9 is similar to that of FIG. 4 with the exception of assigning different reference numerals to each element and adding a bypassing switch 934, and therefore, only different points will be described hereinafter.

A driving power supply device 931 is constituted of a rectification section 921, a power factor improvement section 922, the bypassing switch 934, and a DC/DC converter 923 and outputs a voltage Vcc1. The bypassing switch 934 is connected in parallel to the power factor improvement section 922 and turned on/off by a control signal (not shown) from the engine controller 212. When the bypassing switch 934 is turned on, the current rectified by the rectification section 921 flows toward the bypassing switch 934 having a low impedance and is then input to the DC/DC converter 923 not through the power factor improvement section 922. Meanwhile, when the bypassing switch 934 is turned off, the current rectified by the rectification section 921 flows toward the power factor improvement section 922, and an output of the power factor improvement section 922 is then input to the DC/DC converter 923. When the FET 906 of the DC/DC converter 923 is duty-controlled in such a state that the bypassing switch 934 is turned off, the voltage Vcc1 is output in such a state that the power factor of the current input to the rectification section 921 is approximately 1. Meanwhile, When the FET 906 of the DC/DC converter 923 is duty-controlled in such a state that the bypassing switch 934 is turned on, although the voltage Vcc1 is output, the power factor of the current input to the rectification section 921 is not enhanced.

The description of the effect obtained by adding the power factor improvement section 922 and the description of the condition that the current flowing to the image forming apparatus 100 is maximum are omitted because the contents are overlapped with the contents described in the embodiment 1.

(2) On/Off Control of Power Factor Improvement Section

Since the power factor improvement section 922 has problems such as heat generation and reduction in efficiency due to switching loss of the FET 903 and generation of noise, it is preferable to operate the DC/DC converter 923 not through the power factor improvement section 922 as much as possible. Further, regarding the loss generated in the power factor improvement section 922, not only the switching loss in the FET 903 but also loss in the choke coil 902 and the diode 904 cannot be ignored. Accordingly, in order to achieve the above object, it is suitable to bypass the choke coil 902 and the diode 904 of the power factor improvement section 922 not only by stopping the switching of the FET 903 but also by turning on the bypassing switch 934. Thus, in this example, when the current value of the current supplied to the heater 136 detected by the fixing current detection section 206 is more than a predetermined value, the bypassing switch 934 is turned off. At the same time, the power factor improvement section 922 is placed in the turned on state, and the FET 903 is duty-controlled. Meanwhile, when the current value of the current supplied to the heater 136 detected by the fixing current detection section 206 is less than a predetermined value, a control in which the bypassing switch 934 is turned on and the power factor improvement section 922 is bypassed is performed.

As the threshold value used for judging the turning on/off of the bypassing switch 934, the current flowing the heater 136 is more suitably used than the current flowing to the DC/DC converter 923, and the reason is as described in the embodiment 1.

Figure 10:
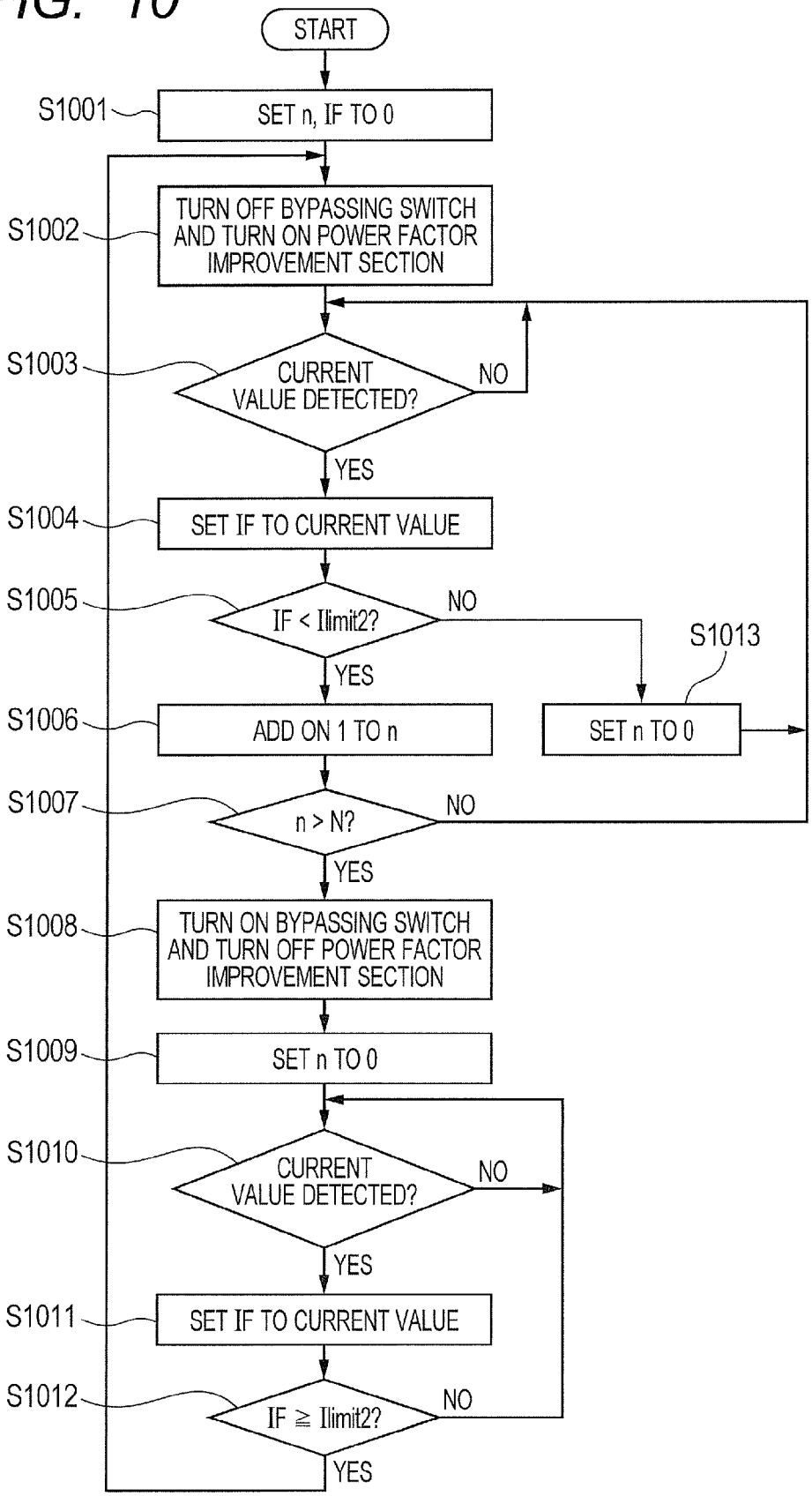
FIG. 10 is a flow chart showing a processing sequence of on/off control of the power factor improvement section in the embodiment 2.

Hereinafter, the on/off control of the bypassing switch 934 will be described based on the current value detected by the fixing current detection section 206, using the flow chart of FIG. 10. FIG. 10 is a flow chart showing a processing sequence of the on/off control of the bypassing switch 934 activated when the power supply of the image forming apparatus is turned on. First, when the power supply of the image forming apparatus 100 is turned on, the processing of S1001 is executed. Since the processing of S1001 is the same as the processing of S601 of FIG. 7, the description here is omitted. The processing sequence in FIG. 10 one-to-one corresponds to the processing sequence in FIG. 7, and the description of the subsequent processing in FIG. 10 the same as the processing in FIG. 7 is omitted.

In S1002, in preparation for warm-up of the image forming apparatus 100, the engine controller 212 turns off the bypassing switch 934 and, at the same time, instructs the turned on state of the power factor improvement section 922 to the power factor improvement control section 941, whereby the power factor improvement control section 941 performs duty control of the FET 903 based on an output of the diode 904, and an output current from a rectification section 901 is input to the DC/DC converter 923 through the power factor improvement section 922. Since the processing of S1003 and S1004 are the same as the processing of S603 and S604 in FIG. 7, the description thereof is omitted.

In S1005, the engine controller 212 judges whether the current value stored in the variable IF is less than a second threshold value Ilimit2, and when the current value stored in the variable IF is less than the threshold value Ilimit2, the operation proceeds to S1006, and otherwise the operation proceeds to S1013. The value of the threshold value Ilimit2 is set so that the value of the current supplied from the commercial power supply 140 to the image forming apparatus 100 does not exceed the standard of current of 15 A even in such a state that the bypassing switch 934 is turned on and, at the same time, the power factor improvement section 922 is in the turned off state. Namely, when the current value detected by the fixing current detection section 206 is less than the second threshold value Ilimit2 (less than the second threshold value), the standard of current of 15 A of the power supply can be satisfied even in such a state that the bypassing switch 934 is turned on and, at the same time, the power factor improvement section 922 is in the turned off state. Since the processing of S1006, S1007, and S1013 are the same as the processing of S603, S607, and S613 in FIG. 7, the description thereof is omitted.

In S1008, the engine controller 212 turns off the bypassing switch 934 and, at the same time, instructs the turned off state of the power factor improvement section 922 to a power factor improvement control section 941. Consequently, the duty control of the FET 903 performed by the power factor improvement control section 941 is stopped, and the output current from the rectification section 901 is input to the DC/DC converter 923 through the bypassing switch 934. Since the processing of S1009, S1010, and S1011 are the same as the processing of S609, S610, and S611, the description thereof is omitted. In S1009, the engine controller 212 writes 0 in the variable n and resets the value. In S1012, the engine controller 212 judges whether the current value stored in the variable IF is not less than the threshold value Ilimit 2, and when the current value stored in the variable IF is not less than the threshold value Ilimit 2 (not less than the second threshold value), the operation proceeds to S1002, and otherwise the operation returns to S1010.

As described above, according to this example, the switching loss of the power factor improvement section can be suppressed. Especially, in this example, even during the image forming operation, the power factor improvement section is bypassed by a bypassing switch in many times, whereby in addition to the effect in the embodiment 1, the loss in the choke coil and the diode can be minimized.

This application claims the benefit of Japanese Patent Application No. 2011-248778, filed Nov. 14, 2011, which is hereby incorporated by reference herein in its entirety.

What is claimed is:

1. An image forming apparatus, comprising:

a power supply section including a rectification section rectifying alternating current supplied from a commercial power supply, a power factor improvement section receiving current output from the rectification section, and a DC/DC converter converting direct current output from the power factor improvement section into direct current;

a fixing section that includes a heater, the fixing section heating and fixing an unfixed image formed on a recording material onto the recording material, wherein a power supply path to the heater is branched from a power supply path from the commercial power supply to the power supply section, and the heater generates heat by power supplied from the commercial power supply without the power factor improvement section;

a current detection section that detects current flowing to the heater through the power supply path to the heater; and a control section that controls operation of the power factor improvement section according to current detected by the current detection section.

2. An image forming apparatus according to claim 1, wherein when the current detected by the current detection section is more than a threshold value, the control section operates the power factor improvement section, and when the current detected by the current detection section is less than the threshold value, the control section stops the operation of the power factor improvement section.

3. An image forming apparatus according to claim 2, wherein the control section operates the power factor improvement section during a warm-up period in which the fixing section is started up in a fixable state, regardless of the current detected by the current detection section.

4. An image forming apparatus according to claim 2, wherein the control section stops the operation of the power factor improvement section when a state in which the detected current is less than the threshold value continues for a predetermined time.

5. An image forming apparatus according to claim 2, wherein the threshold value includes a maximum current value assigned to the heater so that a value of the current supplied from a power supply to the apparatus does not exceed a maximum value of a standard of current in a state that the operation of the power factor improvement section is stopped.

6. An image forming apparatus according to claim 1, wherein the apparatus has a driving power supply supplying electric power to a driver section of the apparatus and a controlling power supply supplying the electric power to a control section of the apparatus including the control section, and a power supply section having the power factor improvement section is the driving power supply.

7. An image forming apparatus according to claim 1, wherein the fixing section further has an endless belt, and the heater is provided inside the endless belt.

8. An image forming apparatus according to claim 7, wherein the heater contacts an inner surface of the endless belt.

9. An image forming apparatus comprising:

a power supply section that includes a rectification section rectifying alternating current supplied from a commercial power supply, a power factor improvement section receiving current output from the rectification section, a DC/DC converter converting direct current output from the power factor improvement section into direct current, and a bypassing switch connected in parallel to the power factor improvement section;

a fixing section that includes a heater, the fixing section heating and fixing an unfixed image formed on a recording material onto the recording material, wherein a power supply path to the heater is branched from a power supply path from the commercial power supply to the power supply section, and the heater generates heat by power supplied from the commercial power supply without the power factor improvement section;

a current detection section that detects current flowing to the heater through the power supply path to the heater; and a control section that controls the bypassing switch according to current detected by the current detection section.

10. An image forming apparatus according to claim 9, wherein when the current detected by the current detection section is more than a threshold value, the control section turns off the bypassing switch and operates the power factor improvement section, and when the current detected by the current detection section is less than the threshold value, the control section turns on the bypassing switch and inputs current output from the rectification section to the DC/DC converter not through the power factor improvement section.

11. An image forming apparatus according to claim 10, wherein when the detected current is less than the threshold value, the control section stops the operation of the power factor improvement section.

12. An image forming apparatus according to claim 10, wherein the control section turns off the bypassing switch and operates the power factor improvement section during a warm-up period in which the fixing section is started up in a fixable state, regardless of the current detected by the current detection section.

13. An image forming apparatus according to claim 10, wherein the control section turns on the bypassing switch when a state in which the detected current is less than the threshold value continues for a predetermined time.

14. An image forming apparatus according to claim 10, wherein the threshold value includes an upper limit current value assigned to the heater so that a value of the current supplied from a power supply to the apparatus does not exceed a maximum value of a standard of current in such a state that the operation of the power factor improvement section is stopped.

15. An image forming apparatus according to claim 9, wherein the apparatus has a driving power supply supplying electric power to a driver section of the apparatus and a controlling power supply supplying the electric power to a control section of the apparatus including the control section, and a power supply section having the power factor improvement section is the driving power supply.

16. An image forming apparatus according to claim 9, wherein the fixing section further has an endless belt, and the heater is provided inside the endless belt.

17. An image forming apparatus according to claim 16, wherein the heater contacts an inner surface of the endless belt.

* * * * *